United States Patent [19]

Doerner

[11] Patent Number: 5,048,176

[45] Date of Patent: Sep. 17, 1991

[54] METHOD OF MAKING A RADIANT HEATER

[75] Inventor: Leonhard Doerner, Oberderdingen, Fed. Rep. of Germany

[73] Assignee: E.G.O. Elektro-Gerate Blanc u. Fischer, Fed. Rep. of Germany

[21] Appl. No.: 385,008

[22] Filed: Jul. 25, 1989

[30] Foreign Application Priority Data

Aug. 19, 1988 [DE] Fed. Rep. of Germany ..... 3828192

[51] Int. Cl.[5] ..... H05B 3/00

[52] U.S. Cl. ..... 29/611; 264/272.18; 219/467; 338/253; 338/269

[58] Field of Search ..... 29/611; 264/272.15, 264/272.18, 272.19; 219/544, 552, 553, 355, 464–468; 338/252, 253, 269, 275, 302, 303

[56] References Cited

U.S. PATENT DOCUMENTS

| | | | |
|---|---|---|---|
| 3,436,816 | 4/1969 | Lemelson | 29/611 |
| 3,500,444 | 3/1970 | Hesse et al. | 338/275 |
| 4,091,355 | 5/1978 | Beck | 338/286 |
| 4,207,672 | 6/1980 | Wohlert | 29/611 |

FOREIGN PATENT DOCUMENTS

| | | | |
|---|---|---|---|
| 71048 | 2/1983 | European Pat. Off. | 219/464 |
| 2820138 | 11/1979 | Fed. Rep. of Germany . | |
| 3206508 | 9/1983 | Fed. Rep. of Germany . | |
| 3527413 | 2/1987 | Fed. Rep. of Germany . | |
| 3602541 | 7/1987 | Fed. Rep. of Germany . | |
| 3709608 | 10/1988 | Fed. Rep. of Germany . | |

*Primary Examiner*—P. W. Echols

*Attorney, Agent, or Firm*—Eckert Seamans Cherin & Mellott

[57] ABSTRACT

A radiant heater with partly embedded and otherwise projecting heating coils (16) is produced in that the coils (16) are placed in grooves (14) of a tool or mold (13), the interior of the heating coils is partly filled with a filling material (17) and then the dry, pourable insulating material is pressed thereon. Thus, the filling material forms a counter-die and is removed on taking the compressed insulator (21) out of apparatus (11) in that it drops between the heating coils.

12 Claims, 1 Drawing Sheet

METHOD OF MAKING A RADIANT HEATER

BACKGROUND OF THE INVENTION

1. Field of the Invention

The invention relates to a radiant heater, particularly for use in heating glass ceramic hotplates, baking-roasting equipment, etc., as well as to a method and apparatus for the production thereof.

2. Prior Art

The fixing of heating coils to insulators for radiant heaters takes place either by insertion in grooves of the insulator, by fixing with clips to the insulator surface or by embedding the heating coil in a moist insulator, into which the coil is pressed and fixed there after drying. The latter method has proved very advantageous, but is relatively complicated and mainly requires fibrous insulating material, which has a good mechanical strength, but has lower thermal insulation characteristics. Therefore an aerosil layer is normally placed under the insulator and which, while having good thermal stability and excellent electrical and thermal insulation characteristics, has a lower mechanical strength.

It is also known to so shape the heating coils at individual points that projections are formed, which are pressed round by the insulator during the production thereof (EP-A-71 048).

Previous attempts to embed heating coils or projections directly into such an aerosil have failed. If it was wished to use such a material, then fixing would have to take place by means of clips or shaped out projections of the heating coils.

SUMMARY OF THE INVENTION

An object of the present invention is to provide a radiant heater, as well as a method and apparatus for its production, in which it is possible to embed the heating coils in the insulator with a good hold therein.

According to the invention this object as achieved by a method in which the insulator, formed from an insulating material, of a radiant heater with heating coils partly embedded therein is produced through the interior of the heating coils being filled with a filling material over part of the cross-sectional surface thereof and which can be introduced into the interior of the heating coils, the insulating material subsequently being applied in such a way that it fills the space left free by the filling material in the heating coil interior and subsequently the filling material is removed. The filling material can be a flowable material, e.g. quartz sand.

The insulating material can be poured in dry form onto the heating coils partly filled with the filling material resting on an appropriate substrate. The insulating material is preferably constituted by a free-flowing material, particularly an aerogel based on pyrogenic silicic acid or alumina, optionally with a fibre reinforcement and with binders and opacifiers.

Prior to the removal of the filling material, the insulating material can be pressed or moulded, so that a relatively solid block is formed, which in many circumstances is sufficient to ensure the necessary strength. The filling material has penetrated between the turns of the heating coils and has partly surrounded the same. As a result of the filling material bed size within the heating coils and also a certain shape with a concave or convex surface, it is also possible to determine the shape of the part of the insulator remaining in the heating coil interior and which forms the embedding. This can also take place in that the heating coil is constructed as an upright oval. It is consequently possible to extend the compression or moulding pressure into the interior of the heating coil, without the latter being deformed or the insulator damaged, if e.g. a heating coil is pressed into the dry, precompressed insulator.

Apart from a good fixing of the heating coil, the resulting insulator has the advantage that part of its inner cross-sectional surface is free from insulating material, so that the radiant heater emission conditions are good and the insulator is not unnecessarily thermally loaded or heated.

Following compression, the insulator is preferably also thermally cured, which can take place at the time of the first use or a trial run. Corresponding known curing agents can be used. It is also possible to introduce a curing agent into the filling material and to allow the latter to penetrate the adjacent areas of the insulating material. In this case preferably the embedding points are cured, which gives an ideal insulator with increased strength in the embedding area, as well as optimum thermal insulation characteristics. In the case of multicomponent curing agent, only one component of said curing agent need be contained in the filling material. It is also possible to dose the curing material in laminated form and to provide an increased dose at the heating coil points.

A preferred apparatus for producing the radiant heaters of the aforementioned type contains a tool or mould, in which the heating coils are partly received in grooves and a device for the partial filling of a fluid or free-flowing filling material into the grooves and a pressing device for the subsequent embedding compression of the heating coils with the insulating material. The free-flowing material is preferably incompressible and forms a "counterpressure die" located in the interior of the heating coil onto which the insulating material can be firmly pressed.

As a result of the method and the apparatus a preferred radiant heater can be produced which, in its interior and over a portion of its internal cross-section through embedding in the insulating material is filled with the latter, so that the heating coil is fixed to the insulator. The insulating material preferably comprises a free-flowing material, especially an aerogel of the aforementioned type. The radiant heater is in particular characterized in that the surface of the insulator portion located in the heating coil interior is the impression of the filling material to be introduced into the heating coil interior.

It has been found that the distance between the individual turns of the heating coil should be larger than the wire thickness, so as to permit a good penetration of the filling material on the one hand and the insulating material on the other into the interior of the heating coil and that the insulator webs ensuring the hold of the heating coil and extending between the wire turns have an adequate cross-section.

BRIEF DESCRIPTION OF THE DRAWINGS

These and further features of preferred embodiments of the invention can be gathered from the claims, description and drawings, the individual features being realizable individually or in the form of subcombinations in an embodiment of the invention and can represent independently patentable constructions, for which protection is hereby claimed. The invention is described in detail hereinafter with reference to the drawings, wherein:

DETAILED DESCRIPTION OF THE PREFERRED EMBODIMENTS

Figure 1:
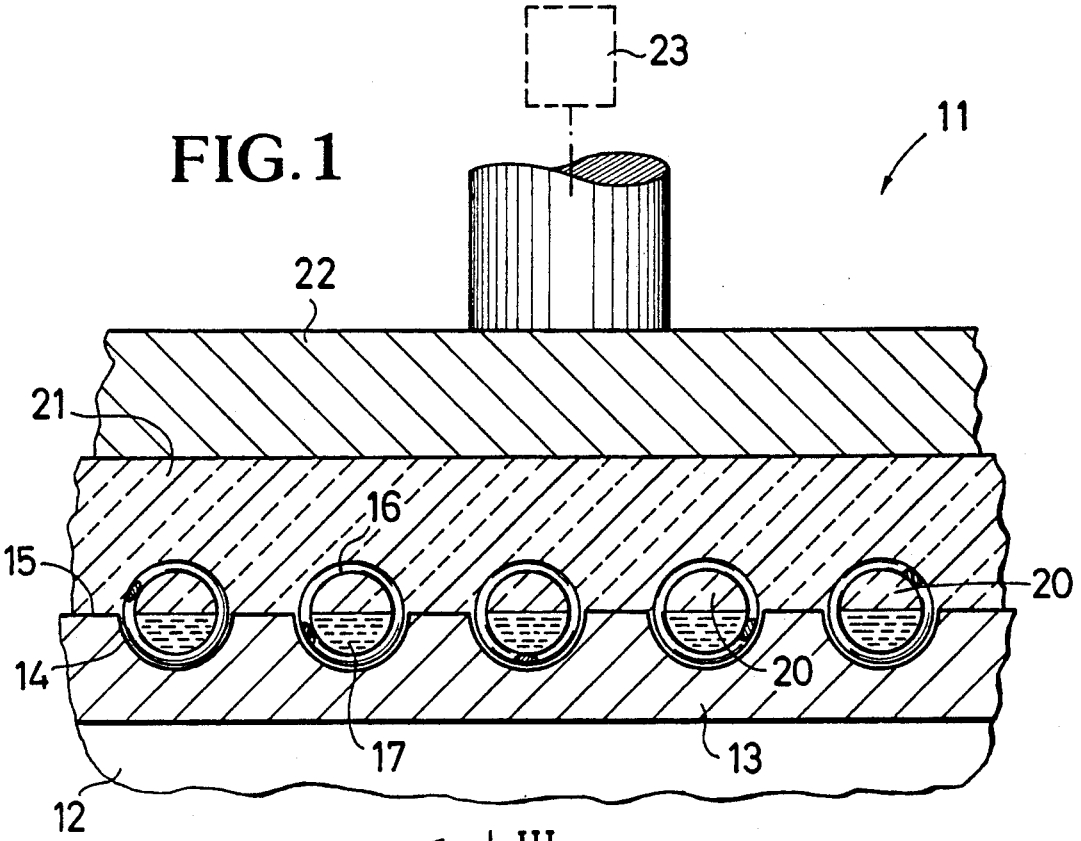
FIG. 1 shows an apparatus for performing the method according to the invention in a partly broken away, diagrammatic vertical section.

FIG. 1 shows an apparatus 11, which is placed on a tool or mold table or stand 12 and carries a tool or mold 13 having the shape of a plate with grooves 14 shaped into its top surface and having a substantially semicircular cross-section. On the upper mould surface 15, the grooves e.g. have a spiral, zig-zag or meandering form, as a function of how the heating coils 16 are to be arranged on the surface of an insulator. In the marginal region, the mould can have recesses, which e.g. shape an all-round edge or rim of an insulator.

Heating coils 16 are inserted in grooves 14 and partly project out of the latter. The portion of the heating coil cross-section projecting upwards out of the grooves, together with the depth of the latter, determines the height of the subsequent embedding of the coils in an insulator 21.

During the production process, a filling material 17, e.g. having quartz sand as the main constituent, is placed in the grooves 14. It is also possible to use a material such as wax or stearin, which is liquid in the warm state. The filling material is preferably filled to such an extent that its surface is substantially flush with the upper mold surface 15. However, it can also be above or below the same and through corresponding introduction or subsequent treatment stages it can assume a specific configuration, e.g. a concave or convex shape, which then determines the shape of the insulator at this point. This could e.g. be performed by vibration or other measures. The shape of the grooves need not precisely correspond to the heating coils. They need only be such that the heating coils are well guided during working or machining. However, in order to avoid an outer surrounding of the heating coils in the groove area, the grooves should be relatively precisely matched to the heating coils. However, only in exceptional cases, should the coils be shaped in accordance with the individual turns.

In certain circumstances the filling material could be introduced prior to the heating coils, if e.g. the latter are introduced from above into the grooves by a vibration process and under a corresponding pressure. The filling material can pass outside the interior of the heating coils into the adjacent grooves. Because of the incompressibility of the filling material, the filling material would continue to push the coil into the insulating material in a fashion similar to a die.

An insulating material is poured onto the thus prepared tool or mold 13 and is preferably an aerogel based on pyrogenic silicic acid or alumina and which can optionally have a fibrous reinforcement. It contains conventional binders and opacifiers, e.g. ilmenite, iron oxide, etc. The insulating material is very light and free-flowing and penetrates well between the turns of the heating coils and fills the portion 20 of the interior of the heating coil not taken up by the filling material 17 and up to the surface of the latter.

This insulating material 21 applied dry in the free-flowing state is then compressed by a press die 22 with an intimated, e.g. hydraulic pressing device 23 against tool or mold 13. The portion 20 located in the interior of the heating coil is also compressed, in that insulating material is forced through the turns. It can be assumed that at the end of the compression or moulding process a substantially homogeneous body of compressed dry insulating material is formed. It can be subsequently treated, in order to allow the thermally curing materials of known consistency contained in the opacifiers or binders to act. The proportion thereof and the degree of compression is a function of the requirements regarding the strength and in particular the abrasion resistance of the insulator. An additional partial hardening in the vicinity of the embedding can take place by displacing the filling material 17 with a curing agent, which is forced out of the filling material on compression or penetrates in capillary manner into the adjacent parts of the insulator. It is also possible to provide the insulator with different curing agent additive proportions and to increase the dosing at the heating coils. Prior to thermal curing the dry compressed insulator 21 is removed from the apparatus, by moving apparatus parts 13, 22 away from one another. The filling material 17 automatically trickles between the turns of the heating coils 16 or remains in the grooves, from where it is either immediately reused, or removed by shaking, blowing or sucking off and can optionally be reused after working up. The filling material can be constituted by all free-flowing materials or those which are to a certain extent fluid, which are largely incompressible and, e.g. by internal friction of the individual particles from which they are formed, cannot be displaced in the same way as a pure liquid or penetrate the insulating material. The consistency is therefore normally between "pulverulent" and "granular", while it is also liquid when wax or stearin is used.

Figure 2:
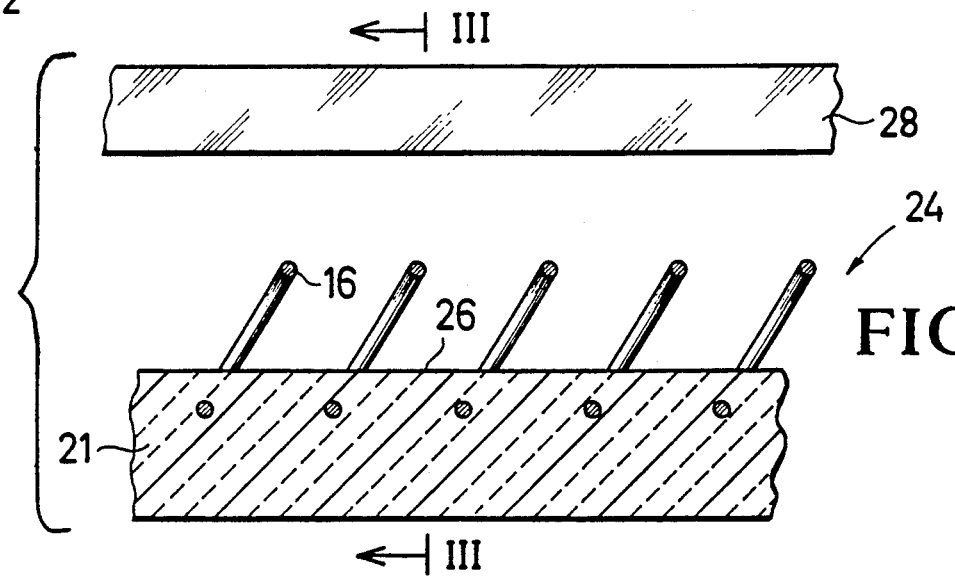
FIG. 2 is a larger scale sectional representation of part of a radiant heater according to the invention.
Figure 3:
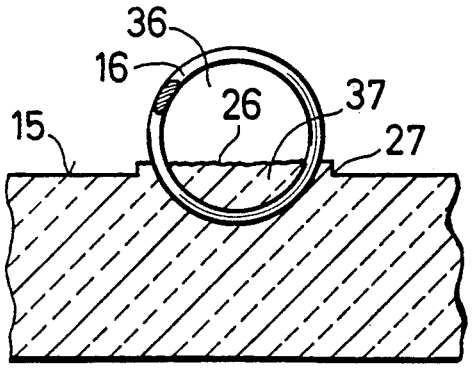
FIG. 3 is a section along line III in FIG. 2.

FIGS. 2 and 3 show the finished radiant heater in its use position with an upward radiation or emission direction. FIG. 2 shows a glass ceramic plate 28 under which the radiant heater 24 is located and radiates upwards through the same. However, the radiant heater is also suitable for other purposes, e.g. for heating ovens and the like.

FIG. 3 shows that the heater can be clearly distinguished from heaters produced in some other way, because normally in the vicinity of portion 37 of its surface 26 located in the heating coil interior, it has a different structure to that of the surface 15 formed by tool 13. Normally this structured surface 26 starts outside the heating coil 16, where it forms a small edge 27. As a function of the degree of pouring of the filling material 17, surface 26 is somewhat higher or lower than surface 15. If grooves 14 are just filled before compression starts, then surface 26 is somewhat higher, because the filling material settles somewhat during compression.

Other methods are possible for complete or only surface hardening. A thermal curing can be carried out during operation. Through a corresponding construction of the mold or tool, the surface 26 and optionally also surface 15 can be simply given a random configuration. Thus, it is e.g. possible to fit the heating coils in the vicinity of a rib running parallel to or crossing the same, or a longitudinally directed projection. This can be achieved by a corresponding construction of the surface of tool 13 and the grooves, as well as by a special pouring form. Thus, e.g. pouring can take place by means of pouring channels or nozzles running along the grooves and which lead to a specific pattern of the filling material in the heating coil interior. Thus, e.g. when pouring with a "heap", a concave shape of portion 17 adapted to the curvature of the heating coil turns can be obtained. Advantageously when pouring through the applied heating coils, the area beneath a heating coil can be made somewhat less high by a cover, so that at this point the insulating material is somewhat higher and therefore permits a surrounding of in particular the heating coil. In this case surface 26 in FIG. 2 would have a corrugated shape sinking between each of the heating coils.

As can be gathered from FIGS. 2 and 3, the insulator portion 37 preferably only surrounds the lower part, preferably one third to one half of the circumference of the turns of heating coils 16, which is adequate for good fixing. It is important that considerable portions of the heating coil and correspondingly a portion 36 taking up preferably more than half the heating coil cross-section is free from the insulator, so as to be able to freely irradiate. The embedded and left free portions vary as a function of the characteristics of the insulating material and the strength and use requirements on the radiant heater. It is particularly advantageous to use on edge oval heating coils.

I claim:

1. A method for producing radiant heaters having an insulator comprising insulating material and at least one heating coil partly embedded therein, wherein a cross-sectional area of an interior space of said at least one heating coil comprises two portions, a first portion being filled with a filling material able to be brought into said interior space, a second of said portions being left free from filling material, subsequent to filling said first portion said insulating material is applied in such a way that it fills the second portion of said interior space of said at least one heating coil, said filling material being subsequently removed from the first portion.

2. The method according to claim 1, wherein said insulating material is dry on application.

3. The method according to claim 1, wherein said insulating material is compressed prior to removing of said filling material.

4. The method according to claim 1, wherein said insulator is cured after compression.

5. The method according to claim 1, wherein a flowing material is used for providing said filling material.

6. The method according to claim 1, wherein quartz sand is used for providing said filling material.

7. The method according to claim 1, wherein said insulating material comprises a flowing material.

8. The method according to claim 1, wherein said insulating material comprises an aerogel based on pyrogenic silicic acid or alumina.

9. The method according to claim 1, wherein said insulating material comprises at least one of compenents provided by a fiber reinforcement binder and an opacifier.

10. The method according to claim 1, wherein a surface of said radiant heater provided with said at least one heating coil is freed from particles of said filling material by at least one of procedures provided by blowing and suction air following compression.

11. The method according to claim 10, wherein said surface is freed from particles of said filling material after hardening said insulator by curing.

12. The method according to claim 1, wherein said filling material is at least mixed with components of a curing agent, said components of a curing agent penetrating adjacent parts of said insulating material during compression.

* * * * *